US011396407B2

(12) United States Patent
Tsai

(10) Patent No.: US 11,396,407 B2
(45) Date of Patent: Jul. 26, 2022

(54) CONTAINER LID WITH PUSH BUTTON AND LINEARLY TRANSLATING LOCKING MECHANISM

(71) Applicant: Igloo Products Corp., Katy, TX (US)

(72) Inventor: Vincent Tsai, Quincy, MA (US)

(73) Assignee: IGLOO PRODUCTS CORP., Katy, TX (US)

( * ) Notice: Subject to any disclaimer, the term of this patent is extended or adjusted under 35 U.S.C. 154(b) by 161 days.

(21) Appl. No.: 16/678,562

(22) Filed: Nov. 8, 2019

(65) Prior Publication Data

US 2020/0148431 A1 May 14, 2020

Related U.S. Application Data

(60) Provisional application No. 62/757,793, filed on Nov. 9, 2018.

(51) Int. Cl.
*B65D 47/08* (2006.01)
*B65D 51/24* (2006.01)

(52) U.S. Cl.
CPC ..... *B65D 47/0871* (2013.01); *B65D 51/242* (2013.01)

(58) Field of Classification Search
CPC ..... B65D 51/24; B65D 47/04; B65D 47/06; B65D 47/08; B65D 47/0871;
(Continued)

(56) References Cited

U.S. PATENT DOCUMENTS 5,203,468 A * 4/1993 Hsu ..... B65D 47/2037 222/530
5,282,541 A * 2/1994 Chen ..... A47G 19/2266 215/12.1
(Continued)

FOREIGN PATENT DOCUMENTS

CN 103284450 9/2013
CN 203182577 9/2013
(Continued)

OTHER PUBLICATIONS

Young, Lee, International Search Report and Written Opinion issued in application No. PCT/2019US/060533, dated Apr. 2, 2020, 39 pages.

*Primary Examiner* — Kareen K Thomas
(74) *Attorney, Agent, or Firm* — King & Spalding LLP

(57) ABSTRACT

A container lid can include: a body having an opening formed therethrough and a thread pattern formed thereon for mating the container lid to a container; a cap rotatably coupled to the body, the cap configured to rotate between a sealed position in which the cap seals the opening and a released position in which the cap does not seal the opening; a button disposed on the body, the button configured to release the cap from the sealed position, causing rotation of the cap to the released position, upon activation of the button; and a locking mechanism operably coupled to the button, the locking mechanism configured to linearly translate in a horizontal direction with respect to the body between a locked position in which the locking mechanism prevents the activation of the button and an unlocked position in which the locking mechanism allows the activation of the button.

20 Claims, 13 Drawing Sheets

(58) Field of Classification Search
CPC ..... B65D 51/242; B65D 2251/1058; B65D 2251/1066; B65D 47/066; B65D 47/0857; B65D 50/02; B65D 50/06; B65D 51/18; B65D 51/247; B65D 83/0409; B65D 83/0829
See application file for complete search history.

(56) References Cited

U.S. PATENT DOCUMENTS 5,577,624 A * 11/1996 Berta ..... B65D 50/045 215/221
6,279,773 B1 * 8/2001 Kiyota ..... A47G 19/2266 220/709
7,651,002 B2 * 1/2010 Hennemann ..... B65D 47/0828 215/235
8,550,269 B2 * 10/2013 Lane ..... B65D 47/0885 215/229
9,113,698 B2 * 8/2015 Blain ..... B65D 47/32
10,144,551 B2 * 12/2018 Ni ..... H04M 1/0202
2006/0043091 A1 * 3/2006 Pinelli ..... A47G 19/2272 220/254.3
2007/0210093 A1 * 9/2007 Pinelli ..... B65D 47/32 220/715
2012/0118890 A1 5/2012 Gilbert et al.
2012/0187075 A1 * 7/2012 El-Saden ..... B65D 51/242 215/389
2013/0220966 A1 8/2013 Lane
2014/0217128 A1 * 8/2014 Samartgis ..... B65D 47/088 222/472
2014/0263476 A1 * 9/2014 Blain ..... A47G 19/2272 222/545
2015/0060448 A1 3/2015 Coon et al.
2015/0282654 A1 10/2015 Kurabe et al.
2016/0000245 A1 1/2016 Sims
2017/0057707 A1 3/2017 Lin
2017/0144808 A1 5/2017 Choltco-Devlin
2017/0320640 A1 11/2017 Steinmann
2019/0335929 A1 11/2019 Anthony et al.

FOREIGN PATENT DOCUMENTS

CN 203290635 11/2013
CN 205338461 6/2016
CN 106388488 2/2017
CN 109561772 4/2019
CN 112218800 1/2021

* cited by examiner

UNLOCKED POSITION

LOCKED POSITION

CONTAINER LID WITH PUSH BUTTON AND LINEARLY TRANSLATING LOCKING MECHANISM

TECHNICAL FIELD

The present disclosure relates generally to container lids, and more particularly, to a container lid with a push button and a linearly translating locking mechanism.

BACKGROUND

Container lids can include mechanisms, such as caps (e.g., a screw-on cap, a flip cap, a push cap, etc.), for sealing an opening of a container through which fluid may enter and/or exit. To access fluid within the container while the container lid engages the container, a user can typically move or remove the cap relative to the opening of the container such that a fluid path into the container may be provided, allowing the user to drink through the lid. When the user wishes to seal the container (e.g., for transport), the user can move the cap such that the fluid path is sealed. Ideally, the cap seals the fluid path in a leak-proof manner so that leakage of fluid within the container is prevented.

A wide range of container lid designs exist. One such design includes a lid with a push button-activated cap. In this design, pushing a button disposed on a face of the lid can release a cap, thereby opening the lid. However, if the button is accidentally pushed, release of the cap can occur inadvertently, possibly resulting in spillage of the liquid stored inside of the container.

SUMMARY

The present disclosure provides a container lid with a push button and a locking mechanism that can linearly translate in a horizontal direction. The lid can include a cap rotatably coupled thereto that is configured to seal the opening. The button, when activated, can release the cap from the sealed position. The locking mechanism, which is operably coupled to the button, can be capable of locking the button and preventing the cap from being inadvertently released from the lid.

According to embodiments of the present disclosure, a container lid can include: a body having an opening formed therethrough, the body configured to be mated with a container; a cap rotatably coupled to the body, the cap configured to rotate between a sealed position in which the cap seals the opening and a released position in which the cap does not seal the opening; a button disposed on the body, the button configured to release the cap from the sealed position, causing rotation of the cap to the released position, upon activation of the button; and a locking mechanism operably coupled to the button, the locking mechanism configured to linearly translate in a horizontal direction with respect to the body between a locked position in which the locking mechanism prevents the activation of the button and an unlocked position in which the locking mechanism allows the activation of the button.

The button can be formed with a first locking mechanism engagement portion that protrudes toward a rear of the body, and the locking mechanism can be formed with a first receiving portion configured to receive the first locking mechanism engagement portion. In the locked position, the locking mechanism can be positioned such that the first locking mechanism engagement portion abuts a surface of the locking mechanism, thereby preventing the activation of the button. In the unlocked position, the locking mechanism can be positioned such that the first locking mechanism engagement portion can penetrate the first receiving portion, thereby allowing the activation of the button. The first receiving portion can be an opening formed through the locking mechanism.

The button can be formed with a second locking mechanism engagement portion that protrudes toward a bottom of the body, and the locking mechanism can be formed with a second receiving portion configured to receive the second locking mechanism engagement portion. The second receiving portion can be formed with a dividing member that protrudes toward a top of the body, the dividing member configured to interact with the second locking mechanism engagement portion during linear translation of the locking mechanism. The dividing member can be tapered on both sides thereof so as to facilitate the linear translation of the locking mechanism into one of the locked position and the unlocked position. The second receiving portion can be formed such that a feedback sound is produced by the second locking mechanism engagement portion contacting a portion of the second receiving portion during linear translation of the locking mechanism.

When the cap is in the sealed position, the button can be further configured to hold the cap in place. The button can be formed with a cap holding portion that protrudes toward a front of the body, the cap holding portion configured to penetrate an opening of the cap, thereby holding the cap in place. The activation of the button can cause movement of the holding portion toward a rear of the body, thereby reversing the penetration of the opening of the cap. The cap can be formed with a receiving portion in which the opening of the cap is disposed, and respective surfaces of the receiving portion and the holding portion are formed with a tapered portion, such that the tapered portion of the receiving portion is configured to come into contact with the tapered portion of the holding portion during the rotation of the cap.

The button can be disposed on a front of the body, and at least a portion of the locking mechanism is disposed behind the button.

The container lid can further include a spring coupled to the body and the cap, the spring configured to cause the rotation of the cap to the released position upon activation of the button. The spring can be further configured to provide an ongoing bias force that causes the cap to rotate away from the sealed position.

The container lid can further include a rear pin attached to the body. The cap can be coupled to the rear pin such that the cap is configured to rotate about the rear pin, and the spring is at least partially coiled around the rear pin.

The container lid can even further include a handle rotatably coupled to the body. The handle can be coupled to the rear pin such that the handle is configured to rotate about the rear pin, and the rear pin can traverse at least a portion of each of the body, the cap, the spring, and the handle.

The container lid can further include a front pin attached to the body. The button can be coupled to the front pin such that the front pin regulates movement of the button in the front and rear directions of the body, and the button can be formed with a front pin opening configured to receive the front pin.

The container lid can further include a resilient member disposed on the body at a location behind the button, the resilient member configured to provide a counteracting force in response to the activation of the button.

The cap can be further configured to rotate to a stowed position, opposite the sealed position, in which a surface of the cap rotates beyond a stowing member that protrudes from a rear surface of the body, thereby preventing rotation of the cap.

BRIEF DESCRIPTION OF THE DRAWINGS

The embodiments herein may be better understood by referring to the following description in conjunction with the accompanying drawings in which like reference numerals indicate identically or functionally similar elements, of which.

Figure 1:
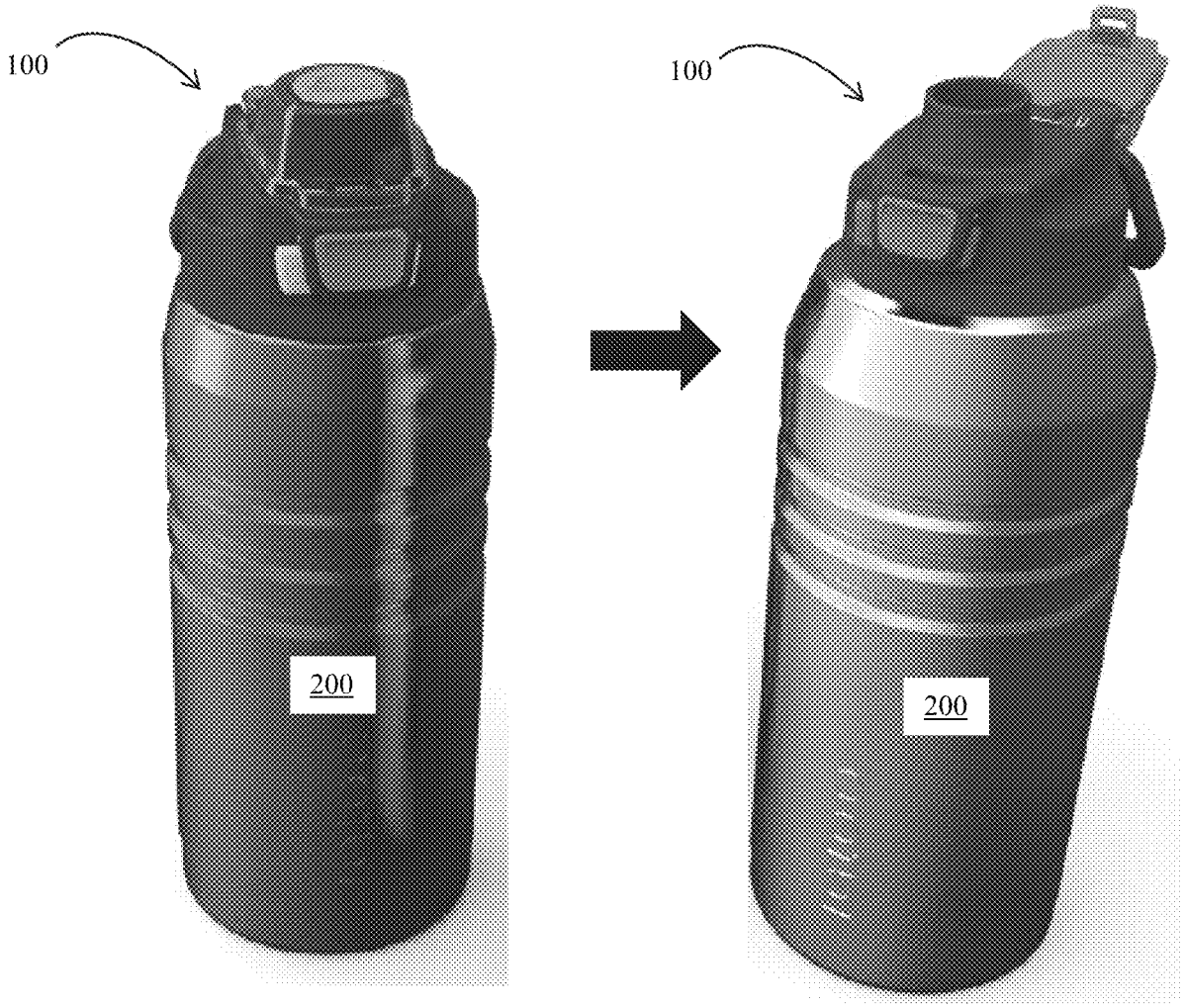
FIG. 1 includes views illustrating a container lid coupled to a container.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

Hereinafter, embodiments of the present disclosure will be described in detail with reference to the accompanying drawings. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Referring now to embodiments of the present disclosure, the disclosed container lid features a push button operably coupled to a locking mechanism that can linearly translate in a horizontal direction. The lid can include a cap rotatably coupled thereto that is capable of sealing the opening. The button, when activated, can release the cap from the sealed position. To prevent the cap from being inadvertently released from the lid, the locking mechanism can be translated into a locked position to lock the button.

FIG. 1 includes views illustrating a container lid 100 coupled to a container 200. As shown in FIG. 1, the lid 100 can be designed so as to engage with the container 200, which may be any suitable container, such as a bottle for carrying liquids or the like. In such case, the lid 100 can prevent spillage of the liquid being carried inside the container 200.

Figure 8A:
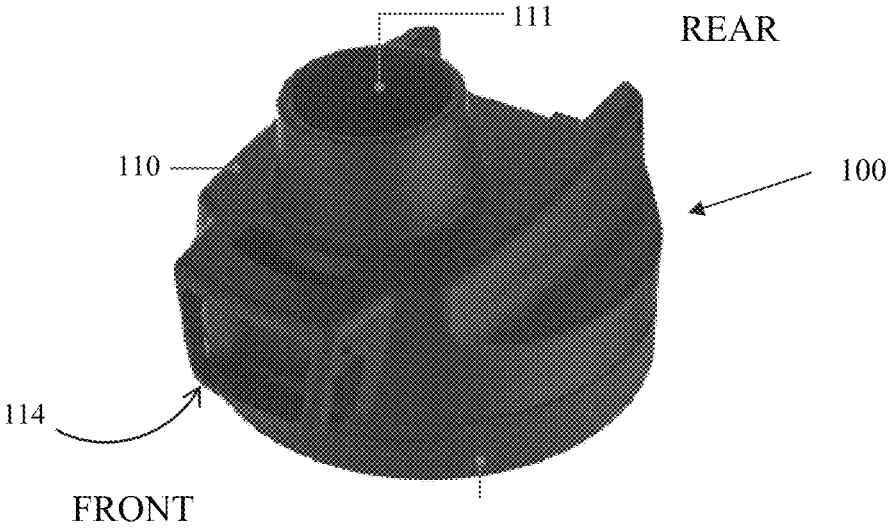
FIGS. 8A and 8B are isolated top and bottom views, respectively, illustrating a body of the container lid of FIG. 1.
Figure 8B:
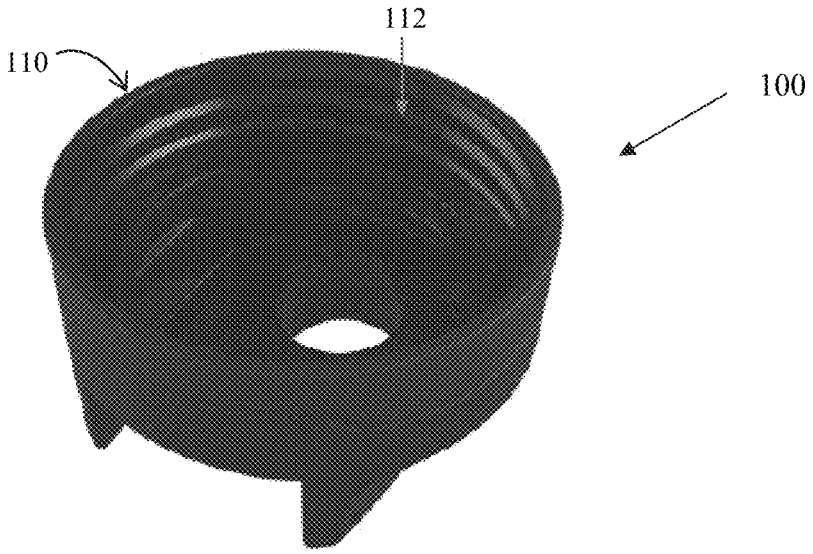

The lid 100 can include a body 110, as shown in greater detail in FIGS. 8A and 8B, which reversibly mates with the container 200. The body 110 can be fashioned using any suitable material, such as Tritan® or any other plastic polymer, for example.

The body 110 can have an opening 111 formed therethrough. The opening 111 can operate as a fluid path, allowing the user to drink through the lid 100 while it is coupled to the container 200. The body 110 can be formed with a thread pattern 112 for mating the lid 100 to the container 200 (via a corresponding thread pattern disposed on the container 200). The thread pattern 112 can be disposed on an interior of the lid body 110, for example. Alternatively, the lid 100 can be designed to engage with the container 200 in any other suitable manner, such as a push-on lid, a snap-on lid, or the like.

Figure 9:
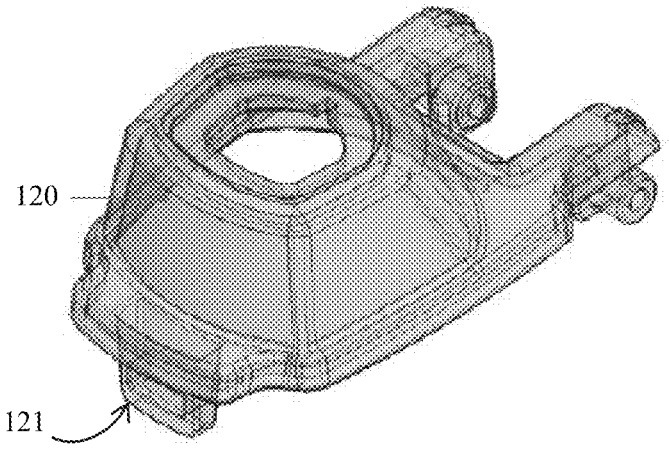
FIG. 9 is an isolated view illustrating a cap of the container lid of FIG. 1.

The lid 100 can further include a cap 120, as shown in greater detail in FIG. 9, which is rotatably coupled to the body 110. The cap 120 can be fashioned using any suitable material, such as Tritan® or any other plastic polymer, for example. In some cases, the cap 120 can be formed with a transparent material.

The cap 120 can be rotatably coupled to a rear portion of the body 110. For example, the cap 120 can be rotatably coupled to the rear portion of the body 110 via a rear pin 170, as shown in greater detail in FIGS. 4A and 4B. In such case, rotation of the cap 120 can occur about the rear pin 170.

Figure 13:
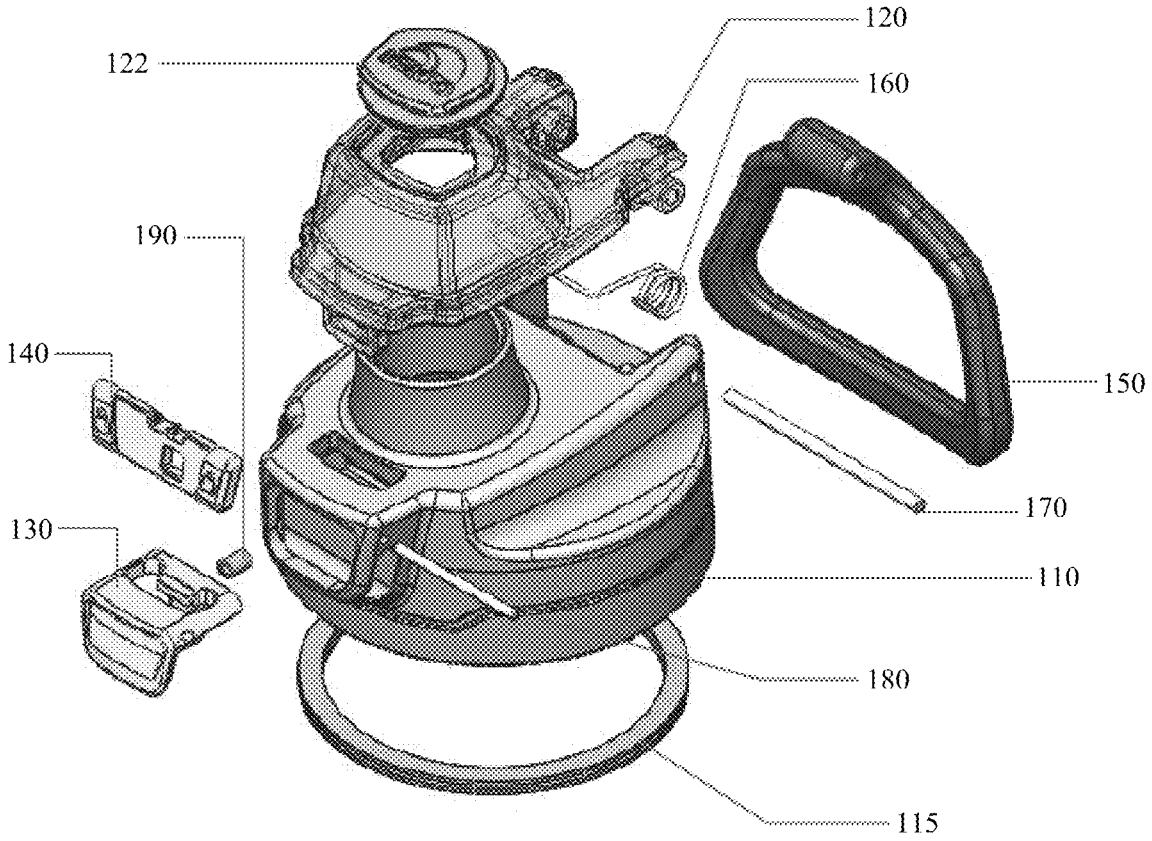
FIG. 13 is an exploded view illustrating the container lid of FIG. 1.

The cap 120 can be configured to reversibly seal the opening 111 of the body 110. In detail, the cap 120 can rotate among a plurality of positions. For example, the cap 120 can rotate between, at least, a sealed position in which the cap 120 seals the opening 111 and a released position in which the cap 120 does not seal the opening 111, as demonstrated in FIG. 1. A cap gasket 122 can be disposed on or within the cap 120 at such a position that, when the cap 120 is in the sealed position, the cap gasket 122, as shown in FIG. 13, can form a leak-proof seal with the opening 111. The cap gasket 122 may be fashioned using any suitable material, such as silicone, for example.

Figure 10:
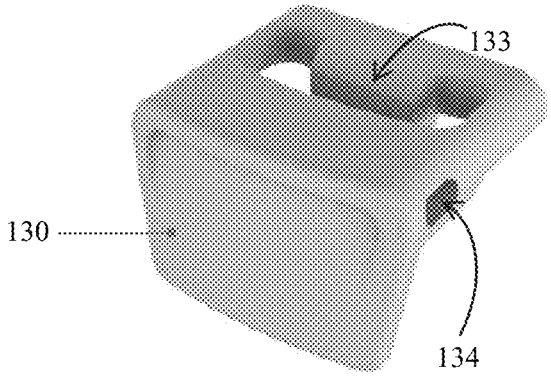
FIG. 10 is an isolated view illustrating a button of the container lid of FIG. 1.

The lid 100 can further include a button 130, as shown in greater detail in FIG. 10, which is disposed on the body 110. The button 130 can be fashioned using any suitable material, such as polypropylene (PP) or other thermoplastic polymers, for example.

The button 130 can be disposed at a front portion of the body 110 such that the button 130 is operably coupled to the cap 120. For example, the button 130 can be inserted in a button housing 114, as shown in FIG. 8A, formed in the front portion of the body 110. The button 130 can be contained within the button housing 114 by a front pin 180, as described in greater detail below.

Operationally, the button 130 can release the cap 120 from the aforementioned sealed position, causing rotation of the cap 120 to the released position, upon activation of the button 130. For the purpose of the present disclosure, activation of the button 130 can correspond to a state in which the button 130 is pushed, as opposed to a state in which the button 130 is at rest.

Figure 2A:
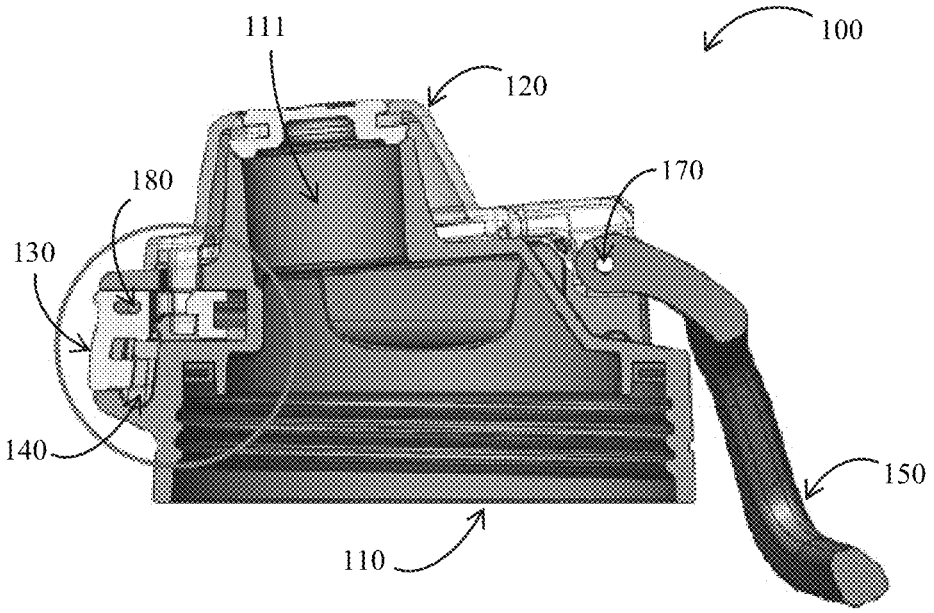
FIGS. 2A and 2B are cross-sectional views illustrating an activation process of a button of the container lid of FIG. 1.
Figure 2B:
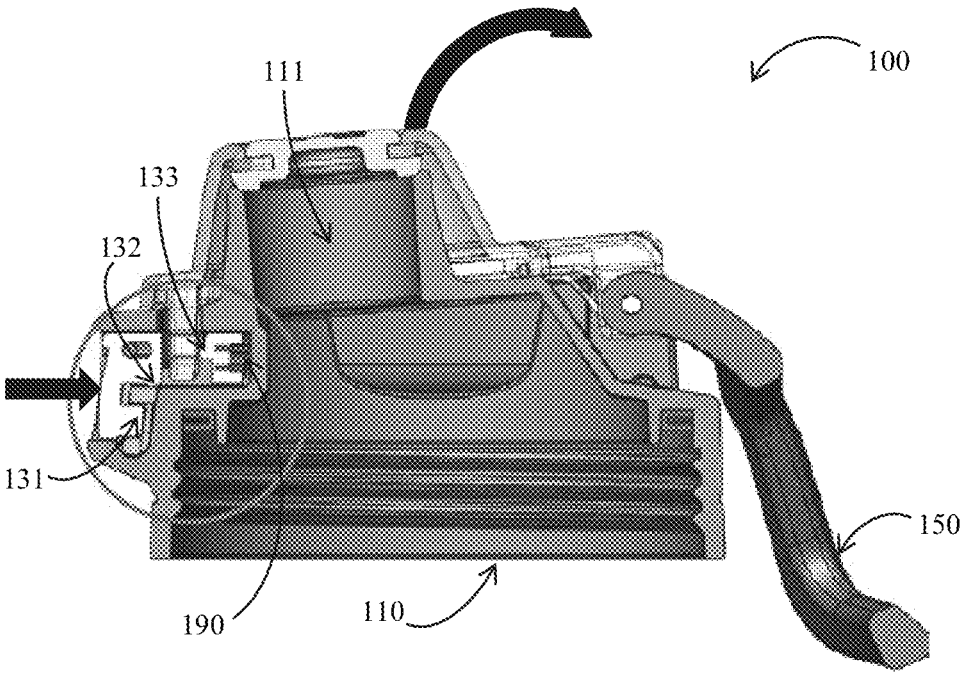

In further detail, FIGS. 2A and 2B are cross-sectional views illustrating an activation process of the button 130. While the button 130 is at rest, as shown in FIG. 2A, the cap 120 can be held in the sealed position in which the cap 120 seals the opening 111 of the body 110. More specifically, the cap 120 can be held in this position by the button 130.

To this end, the button 130 can be formed with a protruding cap holding portion 133, as shown in greater detail in FIG. 10. For example, the cap holding portion 133 can protrude toward the front of the body 110. When the cap 120 is in the sealed position, the cap holding portion 133 can penetrate an opening of the cap 120, thereby holding the cap 120 in place.

The opening of the cap 120 can be formed in a receiving portion 121, as shown in greater detail in FIG. 9. The receiving portion 121 can be formed to protrude downwardly, for example. Thus, when the cap holding portion 133 of the button 130 penetrates the opening in the receiving portion 121, the cap 120 can be held in the sealed position. In some cases, respective surfaces of the receiving portion 121 and the cap holding portion 133 can be formed with a tapered portion (i.e., an inclined surface). The cap 120 and button 130 can be positioned such that the tapered portion of the receiving portion 121 can come into contact with the tapered portion of the cap holding portion 133 during downward rotation of the cap 120 (toward the sealed position). Consequently, the respective tapered portions can facilitate movement of the cap 120 into the sealed position.

When the button 130 is activated, i.e., pressed inwardly, as shown in FIG. 2B, such activation can cause the button 130 to move in a rearward direction. Rearward movement of the button 130 can simultaneously cause rearward movement of the cap holding portion 133, which is integral with the button 130. As a result, the aforementioned penetration of the receiving portion 121 by the cap holding portion 133 can be reversed, resulting in release of the cap 120 and allowing the cap 120 to freely rotate. In other words, activation of the button 130 can cause rotation of the cap 120 to the released position in which the cap 120 does not seal the opening 111 of the body 110, as demonstrated in FIG. 2B.

Figure 3:
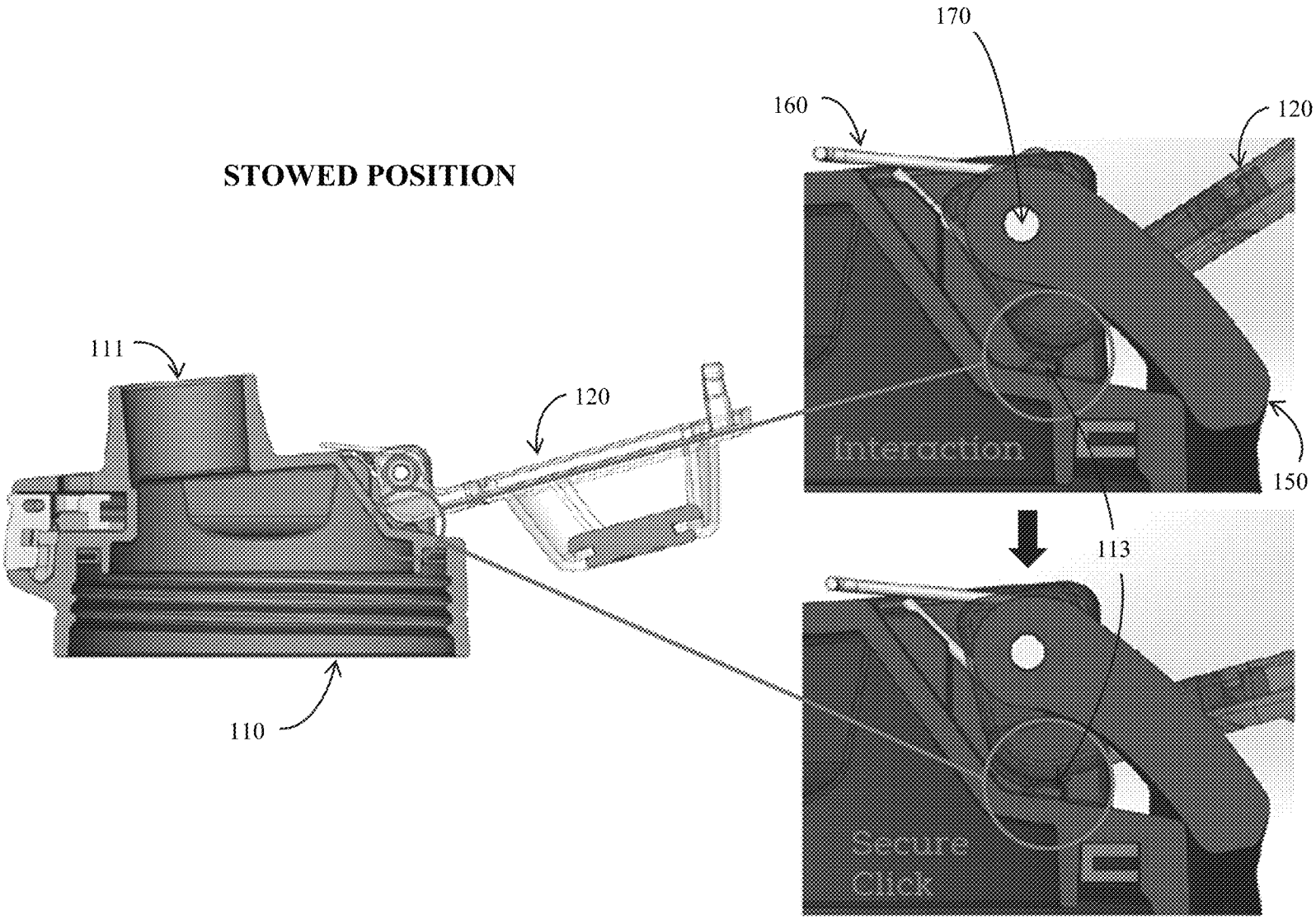
FIG. 3 includes cross-sectional views illustrating a process for stowing a cap of the container lid of FIG. 1.

In addition to rotating between the sealed position and the released position, as described above, the cap 120 can further rotate to a stowed position that is opposite the sealed position. In detail, FIG. 3 includes cross-sectional views illustrating a process for stowing the cap 120. As shown in FIG. 3, the body 110 of the lid 100 can include a protruding stowing member 113 disposed thereon. For example, the stowing member 113 can protrude outwardly from a rear surface of the body 110.

When the cap 120 rotates away from the sealed position shown in FIG. 2A, i.e., toward the rear off the body 110, an outer surface of the cap 120 can abut the stowing member 113, as shown in FIG. 3, protruding from the body 110. For example, a tapered protrusion can be disposed on an outer surface of the cap 120 that is positioned to come into contact with the stowing member 113. At this position, the cap 120 can be rotated approximately 180 degrees away from the stowed position, for example, although the scope of the present disclosure is not limited as such.

Upon contacting the stowing member 113, rotation of the cap 120 can be interrupted. However, an additional rotational force applied to the cap 120 (e.g., a user manually rotating the cap 120) can push the cap 120 beyond the stowing member 113 such that the cap 120 moves into the stowed position, as shown in FIG. 3. Here, the outer surface of the cap 120 can abut the body 110 acting a hard stop against the cap 120 so as to prevent further rotation of the cap 120. Movement of the cap 120 beyond the stowing member 113 can produce a "click"-like sound, indicating to the user that the cap 120 is stowed. At the stowed position, the cap 120 can be secured to the body 110 in an open position, thus allowing for a user to drink through the opening 111 of the lid 100 without interference from the cap 120. Rotation of the cap 120 toward the sealed position can be prevented until an additional rotational force is applied to the cap 120 (e.g., a user manually rotating the cap 120).

Movement of the button 130 in the front and rear directions can be regulated by a front pin 180. The front pin 180 can be attached to the body 110 via one or more openings that is formed in a front portion of the body 110 to receive the front pin 180, such that the front pin 180 traverses the one or more openings of the body 110. The button 130 can be similarly formed with a front pin opening 134 configured to receive the front pin 180, such that the front pin 180 traverses the front pin opening 134, as shown in FIG. 10, of the button 130.

The front pin opening 134, as shown in FIG. 10, can be formed with a width greater than a diameter of the front pin 180, allowing the front pin 180 to be variably positioned within the width of the front pin opening 134. Consequently, the front pin 180 can effectively regulate the forward and rearward movement of the button 130 by restricting movement of the button 130 from a position in which the front pin 180 contacts a front inner surface of the front pin opening 134 to a position in which the front pin 180 contacts a rear inner surface of front pin opening 134.

Furthermore, the lid 100 can include a resilient member 190, such as a spring or other resilient object made of a silicone-based or similarly resilient material, disposed on the body 110 at a location behind the button 130, as shown in FIGS. 2A and 2B. The resilient member 190 can provide a counteracting force in response to the activation of the button 130. Particularly, when the button 130 is pressed by the user, the resilient member 190 can compress, thereby storing potential energy. As the user releases the button 130, the resilient member 190 can expand and release the stored potential energy to push the button 130 in the opposite direction, thus returning the button 130 to its original (i.e., deactivated) state.

As explained above, upon activation of the button 130, the cap 120 can rotate from the stowed position, in which the cap 120 seals the opening 111, away from the opening 111 to the released position. Such rotation can be effected automatically as a result of a spring 160 coupled to the body 110 and the cap 120. The spring 160 can be configured to cause the rotation of the cap 120 to the released position upon activation of the button 130.

Figure 4A:
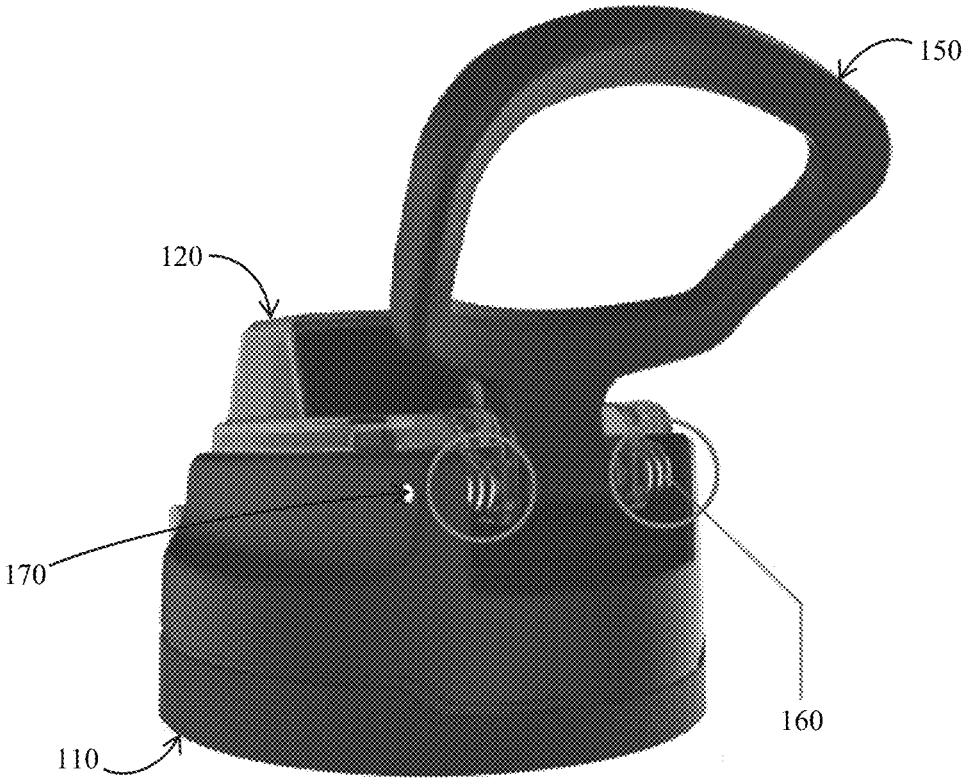
FIGS. 4A and 4B are views illustrating a rear portion of the container lid of FIG. 1 coupled.
Figure 4B:
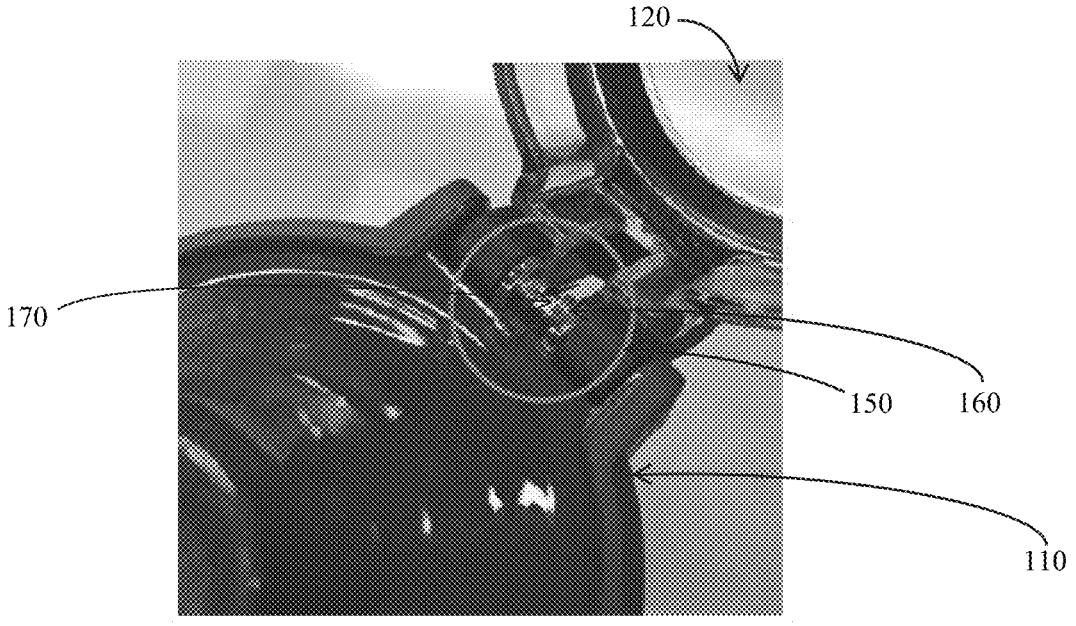

In detail, FIGS. 4A and 4B are views illustrating the rear portion of the body 110. As shown in FIGS. 4A and 4B, a rear pin 170 can be attached to the body 110. For example, one or more openings can be formed in a rear portion of the body 110 to receive the rear pin 170, such that the rear pin 170 traverses the one or more openings of the body 110. The rear pin 170 can be fashioned using any suitable material, such as steel or other metals, for example.

Each of the cap 120 and the spring 160 can be coupled to the rear pin 170. For example, one or more openings can be formed in a rear portion of the cap 120 to receive the rear pin 170. Therefore, the cap 120 can rotate about the rear pin 170, as described above.

Meanwhile, the spring 160 can be at least partially coiled around the rear pin 170, as shown in FIGS. 4A and 4B. Another portion of the spring 160 can extend outwardly from the rear pin 170 and attach to the cap 120. For example, the spring 160 can attach to an underside of the cap 120, although the scope of the present disclosure is not limited as such.

The spring 160 can be configured such that it provides an ongoing bias force that causes the cap 120 to rotate away from the sealed position (i.e., away from the opening 111) toward the stowed position. The spring 160 can be coiled around the rear pin 170 such that it is under tension when the cap 120 is in the sealed position. The spring 160 can, therefore, unwind once the cap 120 is released from the cap holding portion 133. As a result, rotation of the cap 120 toward the stowed position can occur automatically upon activation of the button 130.

Figure 11:
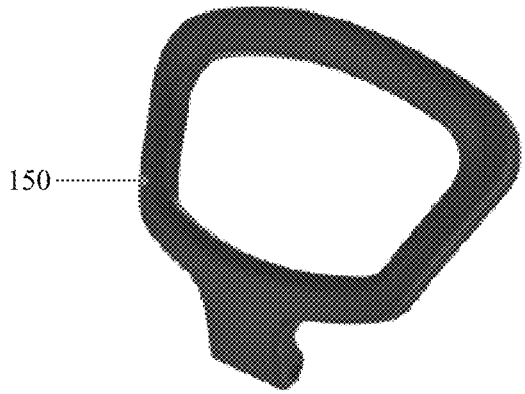
FIG. 11 is an isolated view illustrating a handle of the container lid of FIG. 1.

The lid 100 can further include a handle 150, as shown in greater detail in FIG. 11. The handle 150 can be fashioned using any suitable material, such as thermoplastic polyurethane (TPU) or other thermoplastic polymers, for example.

The handle 150 can be rotatably coupled to the body 110. For example, the handle 150 can be coupled to the rear pin 170, as shown in FIGS. 4A and 4B, such that the handle 150 freely rotates about the rear pin 170. In this manner, the rear pin 170 can traverse at least a portion of each of the body 110, the cap 120, the spring 160, and the handle 150.

Figure 12:
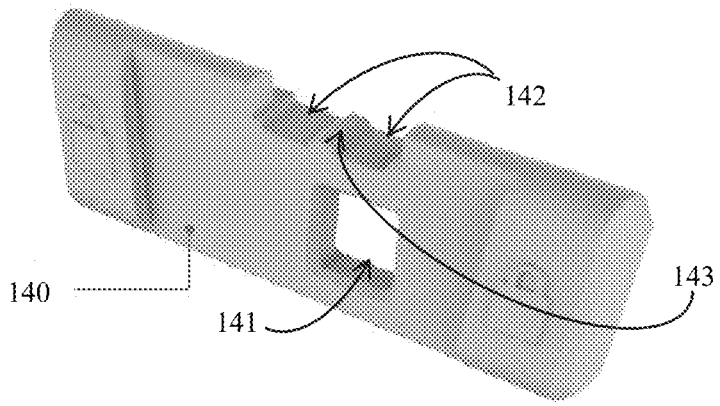
FIG. 12 is an isolated view illustrating a locking mechanism of the container lid of FIG. 1.

The lid 100 can further include a locking mechanism 140, as shown in greater detail in FIG. 12, which is operably coupled to the button 130. The locking mechanism 140 can be formed in a substantially rectangular shape, although the scope of the present disclosure is not limited thereto. The locking mechanism 140 can be fashioned using any suitable material, such as PP or other thermoplastic polymers, for example.

Figure 5:
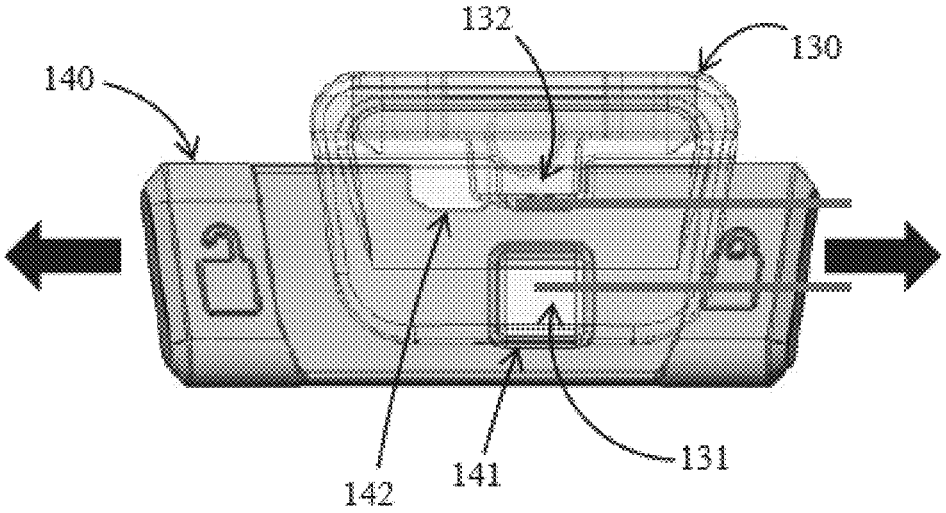
FIG. 5 is a frontal view illustrating a locking mechanism in conjunction with a button the container lid of FIG. 1.

The locking mechanism 140 can be configured to linearly translate in a horizontal direction with respect to the body 110, as shown in FIG. 5, which is a frontal view illustrating the locking mechanism 140 in conjunction with the button 130. The button 130 can be disposed on a front portion of the body 110, as described above, while at least a portion of the locking mechanism 140 can be disposed behind the button 130. Like the button 130, the locking mechanism 140 can be inserted in the button housing 114 of the body 110. The locking mechanism 140 can be permitted to move linearly within the button housing 114, as described in greater detail below, while being contained within the button housing 114 by the button 130.

The locking mechanism 140 can be operably coupled to the button 130 in order to lock the button 130 in place, i.e., prevent activation of the button 130, in accordance with a user's desire to prevent the cap 120 from accidentally opening. That is, the linear movement of the locking mechanism 140 can effect whether or not the button 130 is capable of being activated to release the cap 120 from the sealed position. Particularly, the locking mechanism 140 can translate linearly between a locked position in which the locking mechanism 140 prevents the activation of the button 130 and an unlocked position in which the locking mechanism 140 allows the activation of the button 130. These operations are demonstrated in FIGS. 6A-7B.

The button 130 and locking mechanism 140 can operate in conjunction with each other at least through a series of protrusions disposed on the button 130 and corresponding receiving portions formed in the locking mechanism 140. For example, the button 130 can be formed with a first locking mechanism engagement portion 131 that protrudes toward a rear of the body 110, as shown at least in FIGS. 2A, 2B and 5. Correspondingly, the locking mechanism 140 can be formed with a first receiving portion 141 to receive the first locking mechanism engagement portion 131. The first receiving portion 141 of the locking mechanism 140 can be an opening formed through the locking mechanism 140, for example, as shown in FIG. 12.

The first locking mechanism engagement portion 131 and first receiving portion 141 can be formed at such positions on the button 130 and locking mechanism 140, respectively, that the two features are able to interface with one another. Similarly, the respective shapes of the first locking mechanism engagement portion 131 and first receiving portion 141 can correspond to one another, such that the first locking mechanism engagement portion 131 is able to penetrate the first receiving portion 141, as explained below.

Figure 6A:
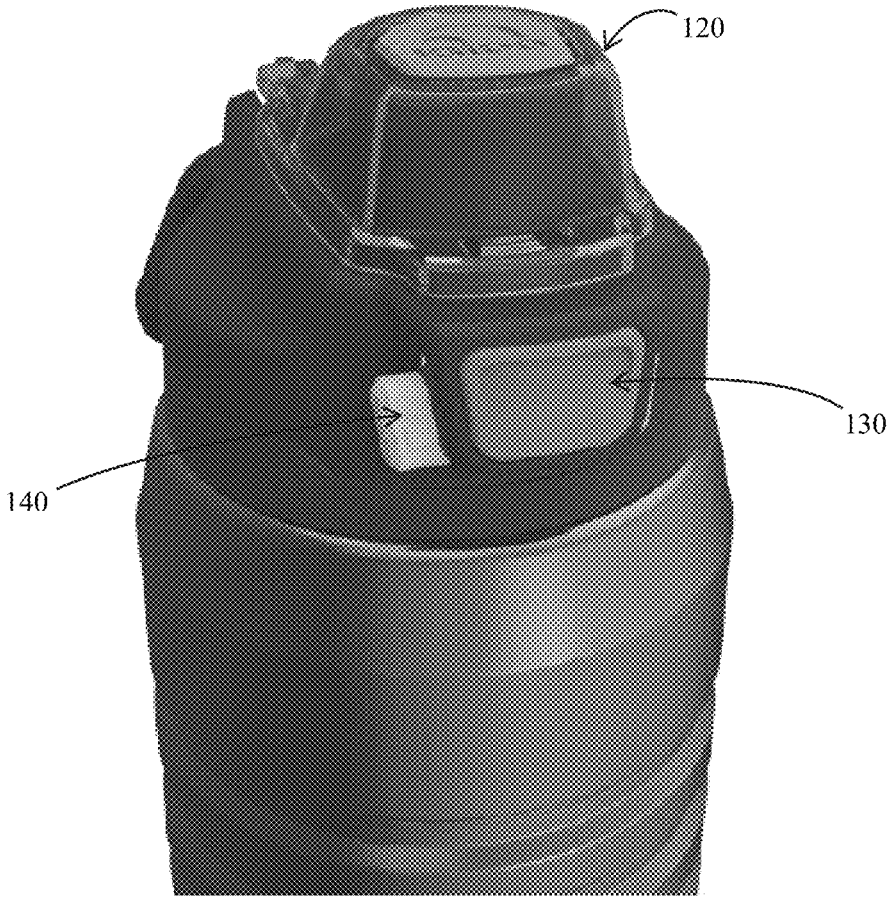
FIGS. 6A and 6B are views illustrating the locking mechanism of FIG. 5 in an unlocked position.
Figure 6B:
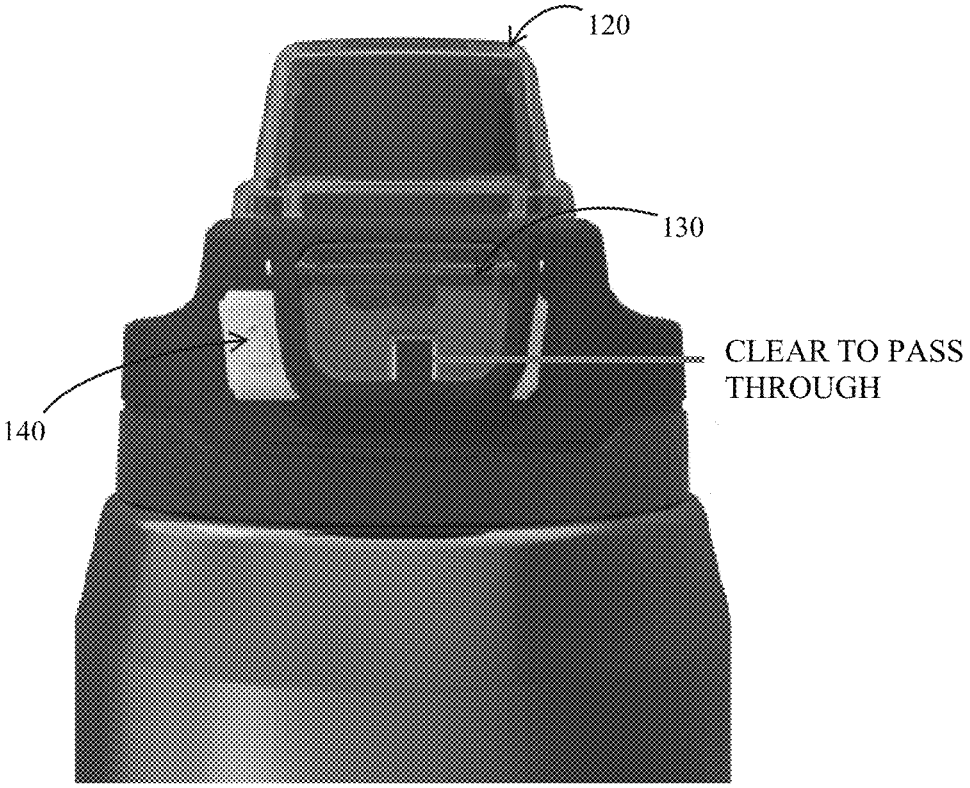

The first receiving portion 141 of the locking mechanism 140 and the first locking mechanism engagement portion 131 of the button 130 can interact with each other so as to control whether the button 130 is able to be activated. Specifically, in the unlocked position, as shown in FIGS. 6A and 6B, the locking mechanism 140 can be positioned such that the first locking mechanism engagement portion 131 can penetrate, i.e., pass through, the first receiving portion 141, which permits the button 130 to be pressed by a user, thereby allowing the activation of the button 130. In FIGS. 6A and 6B, the locking mechanism 140 is shown as being linearly translated (e.g., moved or slid) to the left in a horizontal direction with respect to the body 110, although the scope of the present disclosure is not limited as such. At this position, the first locking mechanism engagement portion 131 can be in alignment with the first receiving portion 141 such that the first locking mechanism engagement portion 131 is able to penetrate the first receiving portion 141.

Figure 7A:
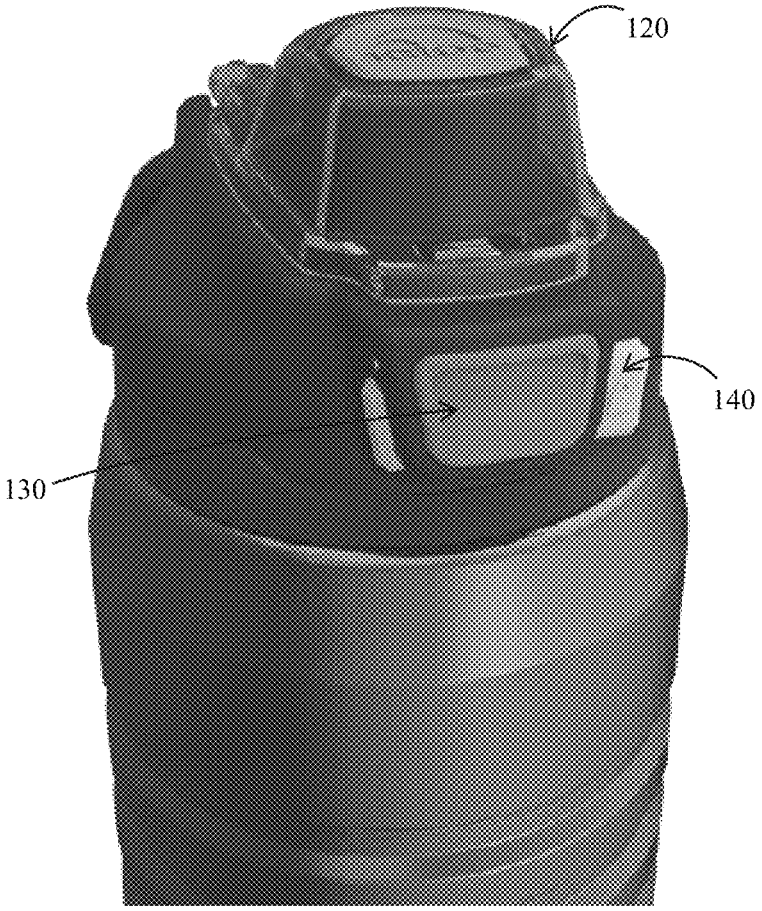
FIGS. 7A and 7B are views illustrating the locking mechanism of FIG. 5 in a locked position.
Figure 7B:
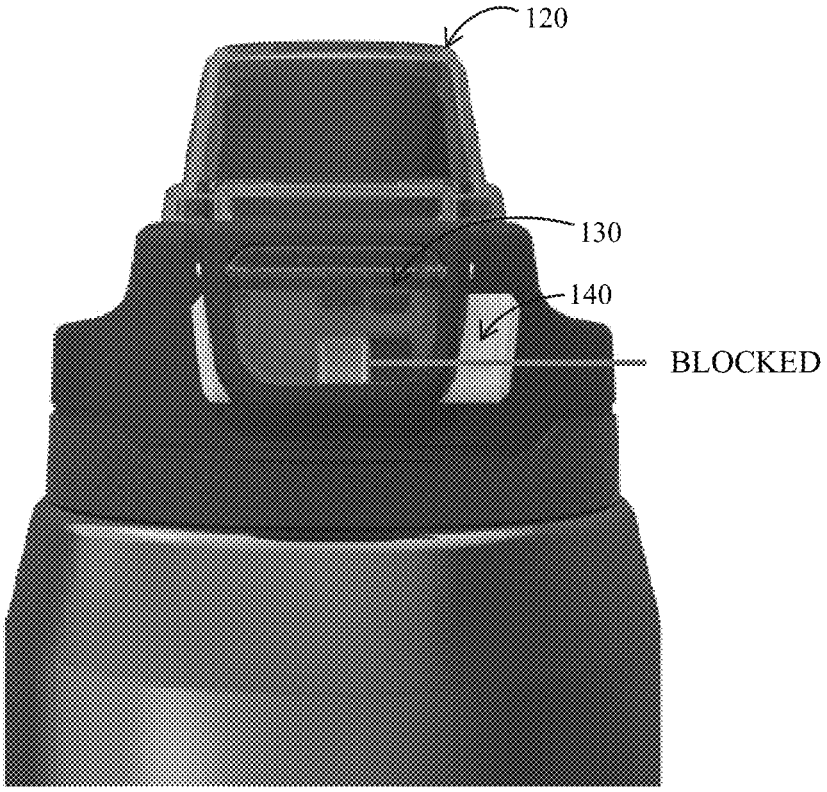

In the locked position, as shown in FIGS. 7A and 7B, the locking mechanism 140 can be positioned such that the first locking mechanism engagement portion 131 abuts a surface of the locking mechanism 140, which prohibits the button 130 from being pressed, thereby preventing the activation of the button 130. In FIGS. 7A and 7B, the locking mechanism 140 is shown as being linearly translated to the right in the horizontal direction, although the scope of the present disclosure is not limited as such. At this position, the first locking mechanism engagement portion 131 can be misaligned with the first receiving portion 141 such that the first locking mechanism engagement portion 131 is unable to penetrate the first receiving portion 141. Instead, a surface of the locking mechanism 140 adjacent to the first receiving portion 141 can block the first locking mechanism engagement portion 131 from moving inwardly (i.e., in the rearward direction).

In addition, the button 130 can be formed with a second locking mechanism engagement portion 132 that protrudes toward a bottom of the body 110, as shown at least in FIGS. 2A, 2B and 5. Correspondingly, the locking mechanism 140 can be formed with a second receiving portion 142 to receive the second locking mechanism engagement portion 132. The second receiving portion 142 of the locking mechanism 140 can be an indentation or cut-out portion formed in a top portion of the locking mechanism 140, for example, as shown in FIG. 12.

The second locking mechanism engagement portion 132 and second receiving portion 142 can be formed at such positions on the button 130 and locking mechanism 140, respectively, that the two features are able to interface with one another. The second receiving portion 142 can be formed with a width greater than that of of the second locking mechanism engagement portion 132 such that the second locking mechanism engagement portion 132 is able to be located at different positions within the second receiving portion 142 in response to linear translation of the locking mechanism 140.

In this regard, the second receiving portion 142 can be formed with a dividing member 143 that protrudes upwardly, i.e., toward a top of the body 110, at the approximate center of the second receiving portion 142. The dividing member 143 can be formed to interact with the second locking mechanism engagement portion 132 of the button 130 during linear translation of the locking mechanism 140. Specifically, the dividing member 143 can facilitate the linear translation of the locking mechanism 140 into one of the locked position and the unlocked position, as described above, by being tapered on both sides thereof. When the tapered surface of the dividing member 143 comes into contact with the second locking mechanism engagement portion 132, it can encourage the locking mechanism 140 to move either to the locked or unlocked position, as opposed to remaining positioned therebetween.

Furthermore, the second receiving portion 142 can be formed such that a feedback sound is produced by the second locking mechanism engagement portion 132 contacting a portion of the second receiving portion 142 during linear translation of the locking mechanism 140. In particular, as the locking mechanism 140 is facilitated to either the locked or unlocked position by the dividing member 143 of the second receiving portion 142, the resultant linear movement can cause the second locking mechanism engagement portion 132 to contact an inner wall of the second receiving portion 142. Such contact can produce a "click"-like sound, indicating to the user that the locking mechanism 140 is either in the locked or unlocked position.

FIG. 13 is an exploded view illustrating the lid 100 and a plurality of components disposed therein. In addition to the various components described hereinabove, the lid 100 can include additional or alternative components in accordance with the present claims, as would be understood by a person of ordinary skill in the art. For example, the lid 100 can include an annular gasket 115 disposed in an interior of the body 110 so as to ensure a leak-proof seal between the lid 100 and the container 200.

Although specific materials are mentioned above, any and all portions of the container lid 100 described herein may be made of any suitable material such as, but not limited to, plastic, metal, ceramic, or combinations thereof. Plastics of the present disclosure may include, for example, polyethylene terephthalate (PET), high density polyethylene, low density polyethylene, vinyl, polypropylene, and polystyrene. Additionally, suitable metals of the present disclosure may include aluminum and iron (e.g., steel, stainless steel, and cast iron). Any seal herein disclosed may be made of any suitable sealing material such as, but not limited to rubber, plastic, soft plastic and/or foam.

Accordingly, the container lid disclosed herein features a push button operably coupled to a locking mechanism that can linearly translate in a horizontal direction. The button, when activated, can release a cap from a sealed position in which an opening of the lid is sealed. To prevent the cap from being inadvertently released from the lid, the locking mechanism can be translated into a locked position to lock the button.

The foregoing description has been directed to embodiments of the present disclosure. It will be apparent, however, that other variations and modifications may be made to the described embodiments, with the attainment of some or all of their advantages. Accordingly, this description is to be taken only by way of example and not to otherwise limit the scope of the embodiments herein. Therefore, it is the object of the appended claims to cover all such variations and modifications as come within the true spirit and scope of the embodiments herein.

What is claimed is:

1. A container lid comprising:

a body having an opening formed therethrough, the body configured to be mated with a container;

a cap rotatably coupled to the body, the cap configured to rotate between a sealed position in which the cap seals the opening and a released position in which the cap does not seal the opening;

a button disposed on the body, the button configured to release the cap from the sealed position, causing rotation of the cap to the released position, upon activation of the button; and a locking mechanism operably coupled to the button, the locking mechanism configured to linearly translate in a horizontal direction with respect to the body between a locked position in which the locking mechanism prevents activation of the button and an unlocked position in which the locking mechanism allows the activation of the button.

2. The container lid of claim 1, wherein the button is formed with a first locking mechanism engagement portion that protrudes toward a rear of the body, and the locking mechanism is formed with a first receiving portion configured to receive the first locking mechanism engagement portion.

3. The container lid of claim 2, wherein, in the locked position, the locking mechanism is positioned such that the first locking mechanism engagement portion abuts a surface of the locking mechanism, thereby preventing the activation of the button, and, in the unlocked position, the locking mechanism is positioned such that the first locking mechanism engagement portion can penetrate the first receiving portion, thereby allowing the activation of the button.

4. The container lid of claim 2, wherein the first receiving portion is an opening formed through the locking mechanism.

5. The container lid of claim 1, wherein the button is formed with a second locking mechanism engagement portion that protrudes toward a bottom of the body, and the locking mechanism is formed with a second receiving portion configured to receive the second locking mechanism engagement portion.

6. The container lid of claim 5, wherein the second receiving portion is formed with a dividing member that protrudes toward a top of the body, the dividing member configured to interact with the second locking mechanism engagement portion during linear translation of the locking mechanism.

7. The container lid of claim 6, wherein the dividing member is tapered on both sides thereof so as to facilitate the linear translation of the locking mechanism into one of the locked position and the unlocked position.

8. The container lid of claim 5, wherein the second receiving portion is formed such that a feedback sound is produced by the second locking mechanism engagement portion contacting a portion of the second receiving portion during linear translation of the locking mechanism.

9. The container lid of claim 1, wherein, when the cap is in the sealed position, the button is further configured to hold the cap in place.

10. The container lid of claim 9, wherein the button is formed with a cap holding portion that protrudes toward a front of the body, the cap holding portion configured to penetrate an opening of the cap, thereby holding the cap in place.

11. The container lid of claim 10, wherein the cap is formed with a receiving portion in which the opening of the cap is disposed, and respective surfaces of the receiving portion and the cap holding portion are formed with a tapered portion, such that the tapered portion of the receiving portion is configured to come into contact with the tapered portion of the cap holding portion during the rotation of the cap.

12. The container lid of claim 10, wherein the activation of the button causes movement of the holding portion toward a rear of the body, thereby reversing the penetration of the opening of the cap.

13. The container lid of claim 1, wherein the button is disposed on a front of the body, and at least a portion of the locking mechanism is disposed behind the button.

14. The container lid of claim 1, further comprising a spring coupled to the body and the cap, the spring configured to cause the rotation of the cap to the released position upon activation of the button.

15. The container lid of claim 14, wherein the spring is further configured to provide an ongoing bias force that causes the cap to rotate away from the sealed position.

16. The container lid of claim 14, further comprising a rear pin attached to the body, wherein the cap is coupled to the rear pin such that the cap is configured to rotate about the rear pin, and the spring is at least partially coiled around the rear pin.

17. The container lid of claim 1, further comprising a front pin attached to the body, wherein the button is coupled to the front pin such that the front pin regulates movement of the button in the front and rear directions of the body, and the button is formed with a front pin opening configured to receive the front pin.

18. The container lid of claim 1, further comprising a resilient member disposed on the body at a location behind the button, the resilient member configured to provide a counteracting force in response to the activation of the button.

19. The container lid of claim 1, wherein the cap is further configured to rotate to a stowed position, opposite the sealed position, in which a surface of the cap rotates beyond a stowing member that protrudes from a rear surface of the body, thereby preventing rotation of the cap.

20. A container lid comprising:

a body having an opening formed therethrough, the body configured to be coupled to a container;

a cap rotatably coupled to the body, the cap configured to rotate between a sealed position in which the cap seals the opening and a released position in which the cap does not seal the opening;

a button disposed on the body in a button housing of the body, the button configured to release the cap from the sealed position, causing rotation of the cap to the released position, upon activation of the button; and a locking mechanism operably coupled to the button, the locking mechanism configured to linearly translate, perpendicular to the button housing, in a horizontal direction between a locked position in which the locking mechanism prevents activation of the button and an unlocked position in which the locking mechanism allows the activation of the button, the horizontal direction with respect to the body.

* * * * *